US005384920A

United States Patent [19]

Havens

[11] Patent Number: 5,384,920

[45] Date of Patent: Jan. 31, 1995

[54] BEDSIDE TOILET FOR INCAPACITATED PATIENTS

[76] Inventor: Thomas R. Havens, 21000 Farm Rd., Vancleave, Miss. 39564

[21] Appl. No.: 119,002

[22] Filed: Sep. 9, 1993

[51] Int. Cl.[6] ..... A47K 11/06

[52] U.S. Cl. ..... 84/480; 4/478; 5/604

[58] Field of Search ..... 4/254, 480, 571.1, 578.1, 4/579, 449, 478; 5/604, 605, 633, 81.1

[56] References Cited

U.S. PATENT DOCUMENTS

| | | | |
|---|---|---|---|
| 2,380,102 | 7/1945 | Farmer | 5/604 |
| 2,752,610 | 7/1956 | Mabrey | 4/254 X |
| 2,869,614 | 1/1959 | Wamsley . | |
| 3,050,741 | 8/1962 | Coleman . | |
| 3,209,375 | 10/1965 | Parsons | 4/254 X |
| 3,215,469 | 11/1965 | Wamsley . | |
| 3,285,619 | 11/1966 | Kitrell et al. . | |
| 3,341,864 | 9/1967 | Wichmann . | |
| 3,854,773 | 12/1974 | Thomas . | |
| 4,168,549 | 9/1979 | Davies | 4/578.1 |
| 4,334,330 | 6/1982 | Marshall . | |
| 4,369,982 | 1/1983 | Hein et al. | 5/81.1 X |
| 4,685,157 | 8/1987 | James | 4/254 |
| 4,856,123 | 8/1989 | Henderson . | |

FOREIGN PATENT DOCUMENTS

| | | | |
|---|---|---|---|
| 2815763 | 10/1979 | Germany | 5/604 |
| 3607310 | 3/1988 | Germany | 4/480 |

*Primary Examiner*—Charles E. Phillips
*Attorney, Agent, or Firm*—Alexander Norcross

[57] ABSTRACT

A toilet for bed-ridden patients is supported by a flat planar support surface which holds the weight of the patient. One end of the support surface is tapered and rests on the surface of the patient's bed; the other end is supported by a pair of height adjustable legs so that the entire support surface may be set up level, over a range of bed heights. Back and side support rails fit into the support surface, and may be positioned so that the support may be mounted either to the right or the left side of a bed.

1 Claim, 1 Drawing Sheet

BEDSIDE TOILET FOR INCAPACITATED PATIENTS

BACKGROUND OF THE INVENTION

Numerous structures are known for providing a commode or toilet for bed ridden patients.

U.S. Pat. No. 4,334,330 to Marshall shows a commode chair for bedside use. This chair is fully supported by legs on wheels. The chair is placed against the bed, with its back to the bed, arid a back ramp drops onto the bed to ease movement of the patient onto the chair. Pivoting side rails are also shown.

U.S. Pat. No. 3,341,864 to Wichmann shows a portable toilet supported by legs on one side, which is mounted to the side of a wheelchair. This patent also shows leg length adjustment by means of pins and holes in a telescoping leg. The toilet replaces one removable side arm on the wheelchair.

U.S. Pat. No. 3,050,741 to Coleman shows a bedside commode in the form of a wheeled flat table having a central bedpan. The patient is transferred to the table and then strapped in place for support. The table is then cranked into a raised seated position over the bed pan. This device appears primarily for a patient unable to move or sit unsupported.

U.S. Pat. No. 4,856,123 to Henderson et al. (et. al means there is more than one named inventor) discloses a flat platform on wheels which folds to a sitting position. The frame either contains a bed pan or can be rolled into position over a toilet.

U.S. Pat. No. 2,869,614 to Wamsley discloses a wheeled table which can be folded into a stretcher or unfolded into a wheeled seat, with bedpan.

U.S. Pat. No. 3,215,469 to Wamsley discloses a chair with bed pan for an invalid. The claims are primarily to the means for adjusting the position of the back and leg rest.

U.S. Pat. No. 3,854,773 to Thomas discloses a bed side commode chair with adjustable side arms.

U.S. Pat. No. 3,285,619 to Kitrell et al. discloses, as part of a wheel chair, a leg rest which is extensible as a platform over a bed to facilitate movement of the patient into or out of the wheel chair.

SUMMARY OF THE INVENTION

This invention relates to the field of patient care, specifically the provision of toilets for bed-ridden patients.

The invention comprises a flat planar support surface which supports the weight of the patient. One end of the support surface is tapered and rests on the surface of the patient's bed; the other end is supported by a pair of height adjustable legs so that the entire support surface may be set up level, over a range of bed heights.

A symmetrical toilet opening in the midsection of the support surface provides access to a waste receptacle, which may be a bed pan or a disposable plastic waste bag.

A back and side rail assembly is mounted to the support surface by means of a rectangular array of four mounting holes; The mounting is left-right symmetrical, and permits the back rail to be mounted so that the tapered, bed supported end of the surface may be either a left end or a right end of the unit. Thus the unit may be configured to extend from either the left side or the right side of the bed by repositioning the back rail assembly.

Both the back rail assembly and the adjustable support legs fold flat, so that the entire unit may be folded into a flat package for easy storage or movement, when the waste receptacle is removed.

By forming the primary support for the patient as a flat, non-folding surface, supported on one side by the bed, the inventive bed toilet uses the weight of the patient to more securely hold the toilet against the bed as the patient slides or is slid from the bed onto the toilet; further the unit is level and provides continuous support for the patient's weight, without risk of dropping the patient between bed and toilet, as there is no discontinuity between bed and toilet.

It is thus an object of the invention to provide a patient bedside toilet which is provides continuous, non-bending physical support for a patient as the patient is moved from a bed to the toilet.

It is a further object of the invention to provide a bed side toilet which provides a patient support surface co planar with the bed surface, eliminating the need to lift or lower the patient to the toilet.

It is a further object of the invention to show a bed side toilet which resists sideways movement during movement of the patient from the bed to the toilet.

It is a further object of the invention to show a bed side toilet which is easily stored between uses.

These and other objects of the invention may be seen from the detailed description of the invention.

DETAILED DESCRIPTION OF THE INVENTION

Figure 1:
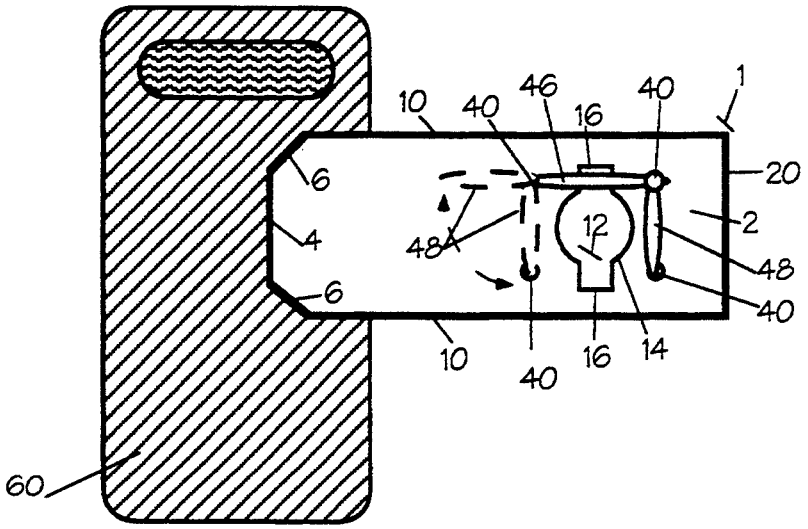
FIG. 1 is a top view of the invention
Figure 2:
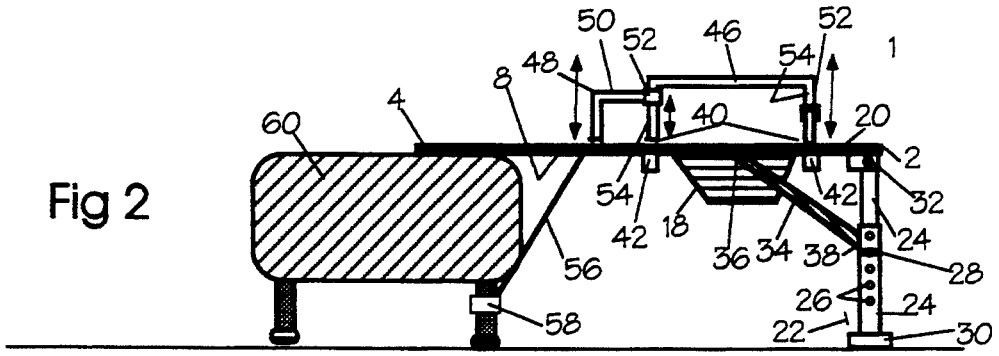
FIG. 2 is a side view of the invention.

Referring to the drawings, the invention is shown to comprise a single, non-folding planar support (2) in the form of a flat sheet, basically rectangular in extent, having one tapered end (4). The tapered end (4) may be formed of a curve, or as shown, by curving or truncating the corners (8) of the rectangle at the tapered end (4).

The support (2) is preferably made of a stainless steel sheet for ease of cleaning, although it may be made of any easily cleaned, stiff but lightweight material, including fiberglass or reinforced plastic. In order to reduce weight so that the invention may be easily handled, the stainless steel sheet is relatively thin, and is stiffened by edge reinforcing angle strips (8), which form an outer edge (10).

At a point midway along the support, or extending up to about two thirds of the length of the support away from the truncated end, is a toilet opening (12). This opening should be left right symmetrical; it may be round or oval. A preferred form, shown in the drawings, is basically round (14) with equal extensions (16) to the front and rear.

Mounted underneath the toilet opening is a waste receiving means (18). This may be a bed pan, mounted so as to be easily removed, preferably by sliding into receiving rails (not shown). In the preferred embodiment this is a disposable plastic pouch, secured by clamps under the opening.

At the end (20) away from the truncated end (4), the toilet is supported by two folding adjustable legs (22). Each leg is formed of two telescoping tubes (24), each having a vertical pattern of holes (26). The length of the legs (22) may thus be adjusted and fixed by placing a locking pin (28) through aligned holes (26) in the inner and outer tubes (24). The legs (22) have rubber, non skid feet (30) on the bottom ends, and are hinged at the top end (32) to fold against the support (2). A folding brace (34) extends from a point (36) on the edge (10) of the support (2) to a point (38) on the folding leg, to brace the leg (22) in the open position. Such adjustable leg structures are known in the art, and any such known folding leg structures will serve.

Centered on the toilet opening (12), and symmetrically arraigned around it, is a rectangular pattern of four rail support openings (40). These openings (40) are reinforced by short, vertically extending pipe sections (42), which extend down below the level of the support (2); the surface of the support (2) is kept smooth with no upward protrusion. Matching these opening is a folding back support rail assembly.

The back support rail assembly comprises a back rail (46), formed from a continuous length of tubing, folded to form an inverted U shape, and sized to exactly fit into either pair of two adjacent rail support openings (40) along either side of the support (2). Two L shaped lengths of tubing form the folding side rails (48). Each side rail (48) has an upper end (50) which is formed into a sleeve (52), which encloses and slides vertically along one side leg (54) of the back rail (46). Each side rail (48) is sized to fit into the support opening (40) directly opposite its respective back support rail side leg (54).

An optional security chain (56) may be fixed to the underside or edge (10) of the support (2), extending over to the bed (60). A clip fastening (58), such as an S hook or a snap clip is fitted at the end of the chain.

In use, the legs (22) of the invention (1) are unfolded, adjusted to the height of the patient's bed (60), and locked in position. The truncated end (4) of the support is then placed on the bed (60), so that the support (2) extends out from the side of the bed (60). Depending on the condition of the patient and the strength of the attendant, the support may extend straight out, or an angled position may be beneficial; the truncated shape of the bed support end (4) makes either position easy.

Once the end (4) of the support (2) is on the bed (60), the patient may be slid on to that end. The patient's weight then serves to secure the toilet (1) to the bed (60). For safety, the security chain (56) may be fastened around the bed frame; however, the patient's weight is the primary force securing the toilet (1) to the bed (60).

The patient is thus slid onto the support (20) while on the bed (60); the patient's weight is on the support (2) before the patient is slid over the toilet opening (12). Depending on the configuration of the patient's room and bed (60), it may be desirable to place the toilet (1) either to the right side or to the left side of the bed (60). Since the support (2) is symmetrical, the back rail (44) may be appropriately positioned for either side, and the side rail (48) on the patient's side is left open; the side rail (48) on the side away from the patient is fixed into the support opening (40). Thus the back (44) and opposite side rail (48) provide fixed support for the patient as he/she is slid in to position over the toilet opening (12).

By forming the patient support (2) as a unitary, non folding flat surface, the patient's weight becomes a factor stabilizing the toilet (1) connection to the bed (60). The patient does not have to be lifted onto the toilet (1). Further, the patient does not have to be re positioned or turned, if that is not advantageous; the toilet (1) can be positioned at an angle and side best for each individual patient's needs. Since there are no folding joints between the bed (60) and the toilet (1), there is no risk of the patient failing between the bed (60) and the toilet (1), nor is there a fold or gap over which the patient must be lifted. Rather, the patient is merely slid over a smooth surface (2) to the toilet (12) and then back into bed (60).

The invention can also be placed over a bath tub to permit more thorough cleansing of a patient who cannot stand and who cannot easily be raised or lowered into a sitting bath. This is particularly useful in the case of a home care patient, where the provision of specialized bathtubs in impractical. In such use, the security chain can secure the unit to the patient's wheel chair, with the truncated end (4) against the wheel chair seat and the legs (22) supporting the unit in the tub. This combined wheel chair and toilet unit then spans the bath tub, forming a stable platform for the bather. Again, the weight of the patient serves to stabilize the unit onto the wheel chair and tub. The patient can then have a shower bath, and can easily wash all areas of the body, including the private parts.

It can thus be seen that the invention is particularly simple in construction, yet it overcomes many disadvantages of the prior art bed side toilets, and significantly lessens the risk of a patient falling between bed and toilet. Since the invention is lightweight and easily stored, it is ideal for home care of the disabled, requiring less skill and strength on the part of the attendant than many prior art devices, and less room to store when not in use.

The description has shown one embodiment of the invention. Within the scope of the claims there are many variations possible in materials and in the construction of the waste receptacle and legs, any of which will serve as part of the invention and all of which variations are considered to come within the scope of the invention.

I claim:

1. A toilet for a bed ridden patient comprising:

a patient support, comprising a flat rectangular support, having a truncated end;

a toilet opening within said support, means for receiving wastes beneath said opening;

four rail support openings symmetrically disposed about said toilet opening;

a rail support assembly comprising a back rail and two side rails foldingly attached to the back rail, said rail support assembly removably inserted into said rail support openings;

folding legs attached to said support at an end opposite said truncated end.

* * * * *